US007971655B2

(12) United States Patent
Steinke et al.

(10) Patent No.: US 7,971,655 B2
(45) Date of Patent: Jul. 5, 2011

(54) HAND-HELD POWER TOOL WITH A VIBRATION-DAMPED ROUNDED HANDLE

(75) Inventors: Hubert Steinke, Leinfelden-Echterdingen (DE); Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 50 days.

(21) Appl. No.: 12/278,503

(22) PCT Filed: Sep. 20, 2007

(86) PCT No.: PCT/EP2007/059970

§ 371 (c)(1), (2), (4) Date: Aug. 6, 2008

(87) PCT Pub. No.: WO2008/055739

PCT Pub. Date: May 15, 2008

(65) Prior Publication Data

US 2009/0025950 A1 Jan. 29, 2009

(30) Foreign Application Priority Data

Nov. 9, 2006 (DE) ..... 10 2006 052 807

(51) Int. Cl.
*B25D 17/24* (2006.01)

(52) U.S. Cl. ..... 173/162.2; 173/162.1; 173/90

(58) Field of Classification Search .... 173/162.1–162.2, 173/90; 294/57

See application file for complete search history.

(56) References Cited

U.S. PATENT DOCUMENTS 1,597,245 A * 8/1926 Prellwitz ..... 173/162.2
3,322,211 A * 5/1967 Alabuzhev et al. ..... 173/162.2
4,060,138 A * 11/1977 Cox et al. ..... 173/49
4,282,938 A * 8/1981 Minamidate ..... 173/162.2
4,401,167 A 8/1983 Sekizawa et al.
4,478,293 A * 10/1984 Weilenmann et al. ..... 173/162.2
4,576,241 A * 3/1986 Emonet ..... 173/162.2
4,673,043 A * 6/1987 Greppmair ..... 173/162.2
4,711,308 A * 12/1987 Blaas et al. ..... 173/162.2
4,749,049 A * 6/1988 Greppmair ..... 173/162.2
4,800,965 A * 1/1989 Keller ..... 173/162.2
5,025,870 A * 6/1991 Gantner ..... 173/162.2
5,095,600 A * 3/1992 Allan ..... 29/81.16

(Continued)

FOREIGN PATENT DOCUMENTS

DE 1 260 399 2/1968

(Continued)

*Primary Examiner* — Lindsay Low

(74) *Attorney, Agent, or Firm* — Michael J. Striker

(57) ABSTRACT

The invention relates to a hand machine tool (2), particularly a percussion drill and/or percussion hammer, comprising a housing (4) having two parallel appendages (20, 22), a hollow, U-shaped, rounded handle (10) with a yoke (24) and two parallel legs (26, 28), said handle being movably supported on springs in relation to the housing (4) for the purpose of damping vibration. The appendages (20, 22) of the housing (4) extend into both hollow legs (26, 28) of the rounded handle (10). The invention also comprises two coupling elements (34, 36) situated in the hollow yoke (24) of the rounded handle (10) which serve to synchronize the movements of both legs (26, 28). The external end faces of the coupling elements (34, 36) are flexibly connected to the appendages (20, 22). The coupling elements (34, 36) are connected on the other end faces thereof to the rounded handle (10), and cross each other, and are flexibly connected to each other at the crossing point.

8 Claims, 2 Drawing Sheets

U.S. PATENT DOCUMENTS

| | | | | |
|---|---|---|---|---|
| 5,522,466 | A * | 6/1996 | Harada et al. | 173/162.2 |
| 5,692,574 | A * | 12/1997 | Terada | 173/162.2 |
| 5,697,456 | A * | 12/1997 | Radle et al. | 173/162.2 |
| 6,076,616 | A * | 6/2000 | Kramp et al. | 173/162.2 |
| 6,148,930 | A * | 11/2000 | Berger et al. | 173/162.2 |
| 6,766,868 | B2 * | 7/2004 | Frauhammer et al. | 173/48 |
| 7,076,838 | B2 | 7/2006 | Meixner | |
| 7,287,601 | B2 | 10/2007 | Hellbach et al. | |
| 7,404,452 | B2 * | 7/2008 | Malkin et al. | 173/162.2 |
| 7,610,967 | B2 * | 11/2009 | Fischer et al. | 173/162.2 |
| 2003/0037937 | A1 * | 2/2003 | Frauhammer et al. | 173/48 |
| 2003/0132016 | A1 * | 7/2003 | Meixner et al. | 173/162.2 |
| 2004/0040729 | A1 * | 3/2004 | Meixner | 173/162.2 |
| 2004/0231867 | A1 * | 11/2004 | Becht et al. | 173/162.2 |
| 2005/0247464 | A1 * | 11/2005 | Hellbach et al. | 173/162.2 |
| 2006/0086515 | A1 * | 4/2006 | Engelfried | 173/162.2 |
| 2008/0000664 | A1 * | 1/2008 | Steinke | 173/162.2 |
| 2009/0272553 | A1 * | 11/2009 | Engelfried et al. | 173/162.2 |

FOREIGN PATENT DOCUMENTS

| | | |
|---|---|---|
| DE | 31 22 979 | 1/1983 |
| DE | 101 38 123 | 2/2003 |
| DE | 10 2004 019 776 | 11/2005 |
| WO | 03/011532 | 2/2003 |
| WO | 2006/021466 | 3/2006 |
| WO | 2007/115845 | 10/2007 |

* cited by examiner

HAND-HELD POWER TOOL WITH A VIBRATION-DAMPED ROUNDED HANDLE

BACKGROUND OF THE INVENTION

The present invention relates to a hand-held power tool, in particular a rotary hammer and/or a percussion hammer, with a housing and a vibration-damped, U-shaped handle that is resiliently supported and is movable relative to the housing.

RELATED ART

With hand-held power tools with an impact drive in particular, such as rotary hammers, chisel hammers, and the like, the hand-held power tool may be subjected to considerable vibrations. When these vibrations are transferred to a handle that is used to press the hand-held power tool against a work piece, the operator perceives the vibrations to be uncomfortable, and long-term exposure thereto may even result in injury. For this reason, double-shelled housings, with which the entire hammer is suspended in an outer shell such that it is resilient in its working direction, have usually been used to provide linear vibration damping of rotary hammers. This design is relatively complex and expensive, however.

Publication WO 03/011532 A1 makes known a hand-held power tool that includes a vibration-damped, rounded handle that is supported such that it is resilient relative to the housing. This handle includes two essentially parallel legs, which are guided into complementary recesses in a grip end of the housing in the working direction of the machine tool such that they are movable in the linear direction. To ensure that the two legs do not tilt in the recesses and then move in a synchronous manner with each other relative to the housing when the operator applies a compressive force to the handle on only one side or not parallel to the working direction of the machine tool, the two legs are connected with the housing via coupling elements. The outer end faces of the coupling elements are hingedly connected to the particular legs, while their inner end faces are hingedly connected with the house, inside the house. Since there is no direct connection between the handle and the vibrating housing, a good decoupling of the handle is attained.

Publication DE 10 2004 019 776 A1 has also already made known to hingedly connect the two legs of a U-shaped, rounded handle of a hand-held power tool with the housing of the machine tool via coupling elements, in order to dampen vibrations.

In addition, a hand-held power tool with a vibration-damped handle is made known in DE 101 38 123 A1, with which one of the two coupling elements that are hingedly connected with the handle and the housing is accommodated inside the hollow handle in a space-saving manner, while the other is located inside the housing.

In addition, a hand-held power tool of the type described initially is shown in FIG. 4 of the unpublished German patent application that belongs to this applicant, with which the two coupling elements are located inside a hollow rounded handle. In that case, the two coupling elements are formed by two-armed levers that are hingedly connected between their end faces to a wall projection of the rounded handle. The outer end faces—which face way from each other—of the two coupling elements are hingedly connected to the free ends of two parallel housing projections that extend through the hollow legs of the rounded handle and into its yoke, in the center of which the facing end faces of the lever arms engage in each other in a hinged manner. The two lever arms bear via a compression spring against a front boundary wall of the yoke that is adjacent to the housing. One disadvantage of this design is the fact that the coupling elements have different shapes, which increases the number of components required and the stockpiling and assembly costs, while another disadvantage is the fact that two compression springs are required, which also increases the number of components required.

Based thereon, the object of the present invention is to improve a hand-held power tool of the type described initially such that the number of components required to decouple the handle from vibrations is reduced.

SUMMARY OF THE INVENTION

This object is attained according to the present invention in that the coupling elements are hingedly connected via their other end faces with the rounded handle, cross each other, and are hingedly interconnected at the crossing point.

With this combination of features, the two coupling elements may have identical designs, and a compressive force applied to the rounded handle may be introduced evenly—via a single compression spring—into both coupling elements, which then transmit the compressive force into the housing of the machine tool in a synchronous manner.

According to a preferred embodiment of the present invention, the crossing point of the two coupling elements is located in a longitudinal central plane of the hand-held power tool, and a single compression spring is inserted between the crossing point and the rounded handle, preferably between the crossing point and a rear boundary wall of the yoke of the rounded handle that faces away from the housing of the hand-held power tool, the single compression spring serving to introduce at least a portion of the compressive force applied to the rounded handle into the coupling elements and symmetrically to the longitudinal central plane.

To maximize the swivel path of the coupling elements within the limited hollow space of the yoke and, therefore, the path of travel of the rounded handle between a front end position and a rear end position, it is provided according to a further advantageous embodiment of the present invention, that the other end faces of the coupling elements—which are not hingedly connected with the projections—are hingedly connected with the wall projections, which extend beyond a front boundary wall—which faces the housing of the hand-held power tool—of the yoke and into its hollow interior.

By changing the distance between the projections and the longitudinal central plane of the machine tool, it is also possible to adjust the length of a lever arm of each coupling element, which extends from a swivel joint located at the crossing point to a swivel joint located on the projection. This also makes it possible to adapt the range of the spring that applies when the rounded handle moves out of the rear end position and into the front end position to the spring characteristic of existing springs.

To simplify manufacture, stockpiling, and assembly, the two coupling elements are advantageously straight coupling rods that have the same shape and dimensions.

BRIEF DESCRIPTION OF THE DRAWING

The present invention is described in greater detail below with reference to an exemplary embodiment shown in the drawing.

DETAILED DESCRIPTION OF THE PREFERRED EMBODIMENTS

Figure 1:
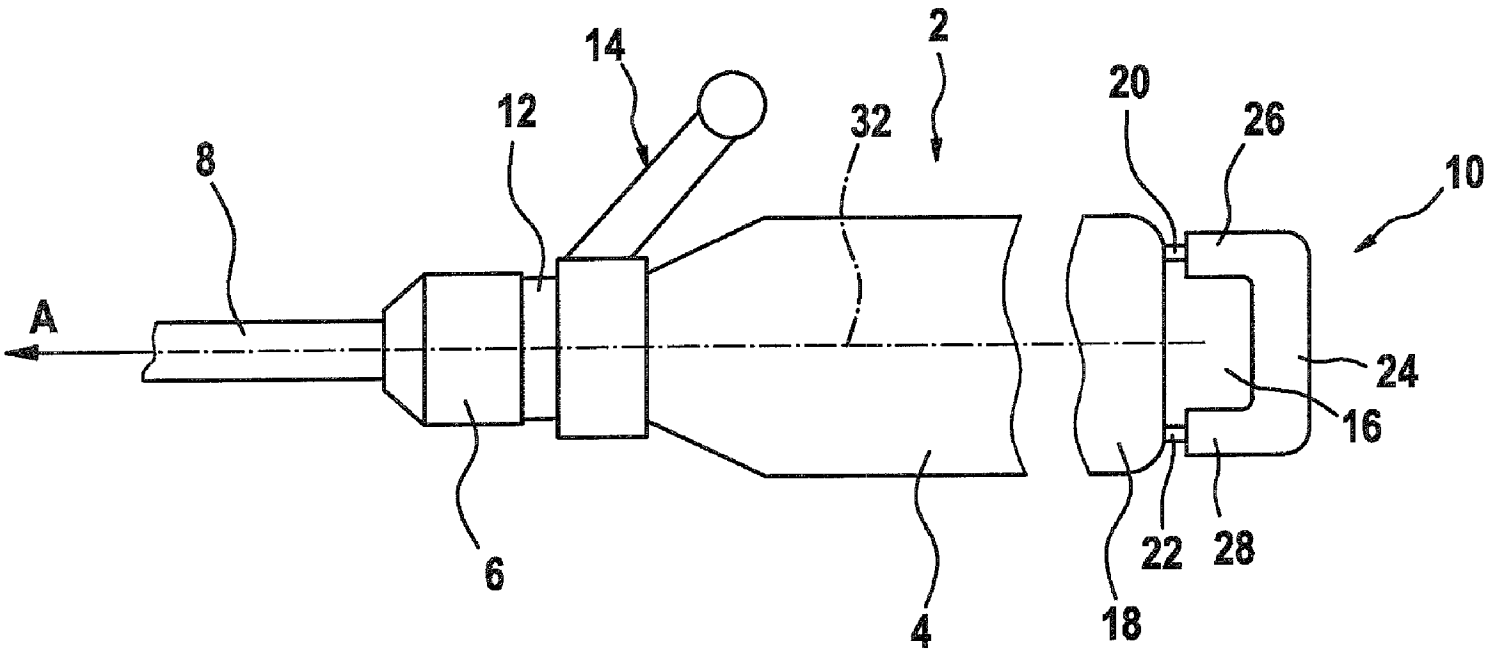
FIG. 1 shows a simplified, schematic side view of a hand-held power tool.

Hand-held power tool 2, which is depicted schematically in FIG. 1 and is designed as a rotary hammer or a percussion hammer, is essentially composed of a housing 4, a tool holder 6 for accommodating a tool 8, and a drive device (not shown) enclosed by housing 4 that drives tool 8 installed in tool holder 6 in a rotating and percussive manner.

The drive device is composed—in a known manner—of an electric drive motor that drives tool holder 6 via reduction gears and a transmission in a rotating manner, and an impact mechanism that is also driven by the drive motor, and with which tool 8 in tool holder 6 may be acted upon with an impact force that acts in a working direction A of machine tool 2.

Housing 4 is provided with a rounded handle 10 on its end face that faces away from tool holder 6. Rounded handle 10 is used—together with an additional handle 14 that is detachably attached to housing 4 near tool holder 6 at 12—to grip and hold machine tool 2. Together with housing 4, rounded handle 10, which extends beyond housing 4, encloses a grip opening 16 for a hand of an operator and makes it easier for him to hold and guide machine tool 2, particularly during vertical operation, i.e., in vertical working direction A and with tool 8 oriented downward, while additional handle 14 is used preferably when working direction A is oriented horizontally or flat.

Figure 2:
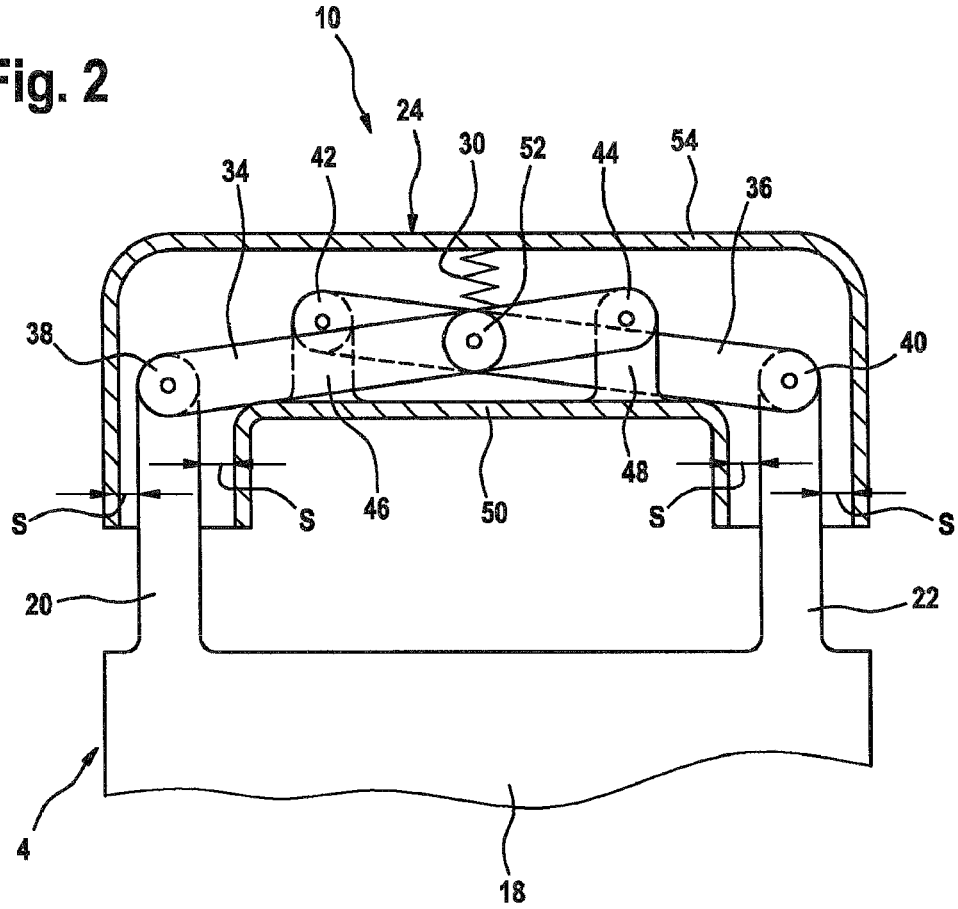
FIG. 2 shows a partially cut-away, enlarged side view of a rounded handle of the hand-held power tool in FIG. 1, with no force applied to the handle.
Figure 3:
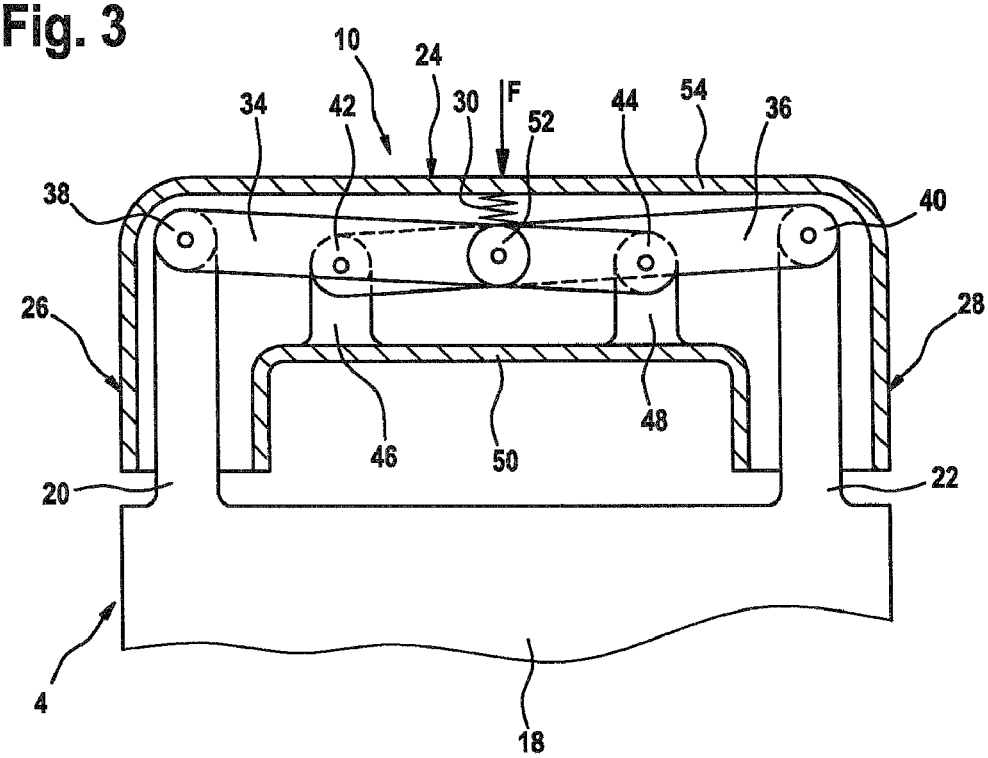
FIG. 3 shows a view similar to FIG. 2, but after the hand-held power tool has been pressed against a work piece, with compressive force applied to the rounded handle.

As shown best in FIGS. 2 and 3, housing 4 includes two parallel projections 20, 22, which project rearwardly beyond rear end face 18 of housing 4, are rigidly connected with housing 4, and extend into the hollow interior of rounded handle 10.

Rounded handle 10 is essentially composed of a hollow yoke 24 that extends perpendicularly to working direction A of hand-held power tool 2 and that is gripped with one hand by the operator in order to use hand-held power tool 2. Rounded handle 10 is also composed of two hollow legs 26, 28 that extend parallel to working direction A and are open at their end faces adjacent to housing 4, thereby enabling projections 20, 22 of housing 4 to enter legs 26, 28.

To prevent the vibrations—caused, e.g., by the impact mechanism of machine tool 4—of housing 4 from being transferred to rounded handle 10—the vibrations not only being perceived as uncomfortable by the operator but also possibly resulting in injury after long-term exposure—the two legs 20, 22 of housing 4 extend into hollow legs 26, 28 of rounded handle 10 with a great deal of lateral play S. In addition, rounded handle 10 does not bear directly against projections 20, 22 or housing 4, but rather via a helical compression spring 30, which serves to decouple vibrations between rounded handle 10 and housing 4.

To prevent rounded handle 10—which has been decoupled from housing 4 in this manner—from tilting when the hand-held power tool is used and a compressive force F (FIG. 3) is applied to rounded handle 10, and this compressive force F is introduced such that it is not parallel to working direction A or it is directed toward one side of a longitudinal central plane 32 (FIG. 1) of hand-held power tool 2, the motions of the two hollow legs 26, 28 along projections 20, 22 are synchronized with the aid of two coupling rods 34, 36.

The two straight, longitudinal coupling rods 34, 36 are accommodated in the hollow interior of yoke 24 of rounded handle 10 and are generally oriented transversely to working direction A and longitudinal central plane 32 of hand-held power tool 2. The outer—that is, located furthest from longitudinal central plane 32—end face of each coupling rod 34, 36 is hingedly connected via a swivel joint 38 or 40 to the free end of an adjacent projection 20 or 22, while the diametrically opposed, inner—that is, located closest to longitudinal central plane 32—end face of each coupling rod 34, 36 is hingedly connected to a projection 46 or 48 via a further swivel joint 42 or 44, projection 46 or 48 projecting extending—on the side of longitudinal central plane 32 opposite to swivel joint 38 or 40—beyond a front boundary wall 50—that faces housing 4—of yoke and into the interior of yoke 24, so that the two coupling rods 34, 36 cross. Coupling rods 34, 36 are hingedly interconnected at their crossing point via a fifth swivel joint 52. Swivel axis of swivel joint 52 is oriented parallel to the swivel axes of the other swivel joints 38, 40, 42, 44, and it lies in longitudinal central plane 32 of hand-held power tool 2.

The two coupling rods 34, 36 bear at their crossing point and/or at swivel joint 52 via helical compression spring 30 against a rear boundary wall 54—that faces away from housing 4—of yoke 24, so that at least a portion of compressive force F applied to rounded handle 10 is introduced via compression spring 30 into coupling rods 34, 36 and, via these, into projections 20, 22 of housing 4.

As compressive force F increases, helical compression spring 30 is compressed to an increasing extent, although its range, i.e., the difference in the length of spring 30 between its slightly compressed state in the rear end position 10 (FIG. 2) and its more highly compressed state in the front end position (FIG. 3) of rounded handle 10, is smaller than the path of travel of rounded handle 10, since—given that the lengths of the lever arms of coupling rods 34, 36 on both sides of swivel joint 52 are different—the crossing point of coupling rods 34, 36 moves slightly out of the rear end position and into the front end position when rounded handle 10 moves, but to a lesser extent than does rounded handle 10 itself.

The front end position of rounded handle 10 is limited by the spring force of compressed helical compression spring 30, which counteracts the motion and is sized accordingly. The rear end position of rounded handle 10 is defined by the two coupling rods 34, 36 impacting the inside of front boundary wall 50 of yoke 24 on the side, next to projections 46, 48, thereby forming end stops for limiting the path of travel of rounded handle 10 away from housing 4.

What is claimed is:

1. A hand-held power tool in the form of a rotary hammer and/or percussion hammer, including:

a housing with two rigid parallel projections, a hollow, U-shaped, rounded handle with a yoke and two parallel legs, wherein said rounded handle is resiliently supported such that said handle is movable relative to the housing in order to dampen vibrations, wherein the projections of the housing extend into said parallel legs of the rounded handle; and synchronizing means for synchronizing motion of the two parallel legs along said projections, wherein said synchronizing means for synchronizing motion of the two parallel legs are two coupling elements accommodated in the yoke of the rounded handle, wherein said coupling elements are provided and configured exclusive to spatially synchronize motions of the legs unidirectionally and to temporally synchronize motions of the legs, wherein the coupling elements cross each other at a crossing point, and are hingedly interconnected at the crossing point, and wherein each of said coupling elements has a first external end face located at one side of said crossing point, spaced from said crossing point in one direction and hingedly connected with one of the projections, and a second end face located at opposite side of said crossing point, spaced from said crossing point in an opposite direction and connected with the rounded handle.

2. The hand-held power tool as recited in claim 1, wherein the crossing point of the coupling elements (34, 36) is located in a central plane (32) of the hand-held power tool and/or in the middle between the two projections (20, 22).

3. The hand-held power tool as recited in claim 1, further comprising a compression spring (30) located between the crossing point of the coupling elements (34, 36) and the rounded handle (10).

4. The hand-held power tool as recited in claim 3, wherein the compression spring (30) is located between the crossing point and a rear boundary wall (54) of the yoke (24) facing away from the housing (4) of the hand-held power tool (2).

5. The hand-held power tool as recited in claim 1, wherein the second end faces of the coupling elements (34, 36) are hingedly connected to projections (46, 48) that extend beyond a front boundary wall (50) of the yoke (24) that faces the housing (4) of the hand-held power tool (2), and into the interior of the yoke (24).

6. The hand-held power tool as recited in claim 1, wherein the two coupling elements (34, 36) have the same shape and dimensions.

7. The hand-held power tool as recited in claim 1, wherein the two coupling elements (34, 36) are straight coupling rods (34, 36).

8. The hand-held power tool as recited in claim 1, wherein the two coupling elements (34, 36) form end stops for limiting a motion of the rounded handle (10) in a rear end position that is located at a distance away from the housing (4) of the hand-held power tool (2).

* * * * *